US005426094A

United States Patent [19]

Hull et al.

[11] Patent Number: 5,426,094

[45] Date of Patent: Jun. 20, 1995

[54] HIGH TEMPERATURE SUPERCONDUCTOR CURRENT LEADS

[75] Inventors: John R. Hull, Hinsdale; Roger B. Poeppel, Glen Ellyn, both of Ill.

[73] Assignee: ARCH Development Corporation, Chicago, Ill.

[21] Appl. No.: 641,822

[22] Filed: Jan. 16, 1991

[51] Int. Cl.[6] ..... H01B 12/00

[52] U.S. Cl. ..... 174/125.1; 505/887; 505/884; 174/15.4; 174/15.5; 174/125.1

[58] Field of Search ..... 174/15.4, 15.5, 125.1; 505/1, 100, 884, 887

[56] References Cited

U.S. PATENT DOCUMENTS 4,980,964 1/1991 Boeke ..... 174/125.1
4,983,572 1/1991 DeWith ..... 505/1
4,983,574 1/1991 Meyer ..... 505/1

FOREIGN PATENT DOCUMENTS 0242533 9/1990 Japan ..... 174/125.1

OTHER PUBLICATIONS

Mishishita et al., Ag-Doped Bi—Sr—Ca—Cu—O Superconductor Prepared by Floating Zone Method, 1989, pp. 273–276.

Yokoyama et al. "Low resistivity contacts to $YBa_2Cu_3O_{7-y}$ superconductors using $Ag_2O$ powder", Cryogenics 1988 vol. 28 Nov., pp. 734–736.

Ottowitz "Superconductive wire", Wire and Wire products vol. 39, No. 3, Mar. 1964, pp. 407, 433 and 435.

Jim et al. "Low-resistivity contacts to bulk high Tc Superconductors", Appl. Phys. Lett. 54(25), 19 Jun. 1989, pp. 2605–2607.

*Primary Examiner*—Leo P. Picard
*Assistant Examiner*—Hyung S. Sough
*Attorney, Agent, or Firm*—Reinhart, Boerner, Van Deuren, Norris & Rieselbach

[57] ABSTRACT

An electrical lead having one end for connection to an apparatus in a cryogenic environment and the other end for connection to an apparatus outside the cryogenic environment. The electrical lead includes a high temperature superconductor wire and an electrically conductive material distributed therein, where the conductive material is present at the one end of the lead at a concentration in the range of from 0 to about 3% by volume, and at the other end of the lead at a concentration of less than about 20% by volume. Various embodiments are shown for groups of high temperature superconductor wires and sheaths.

18 Claims, 2 Drawing Sheets

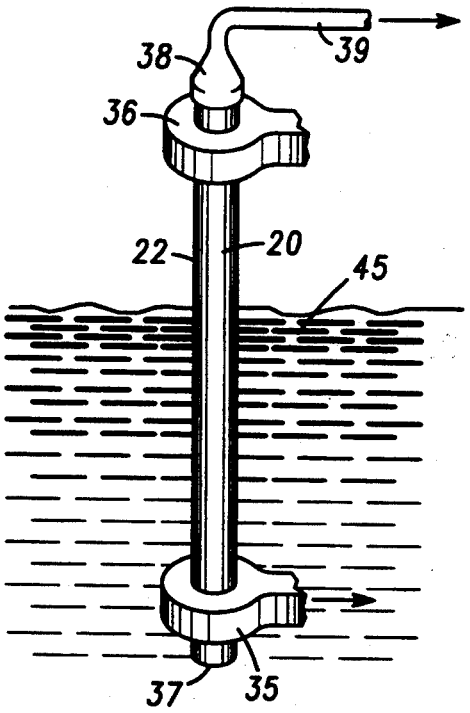
Fig. 6
Fig. 7
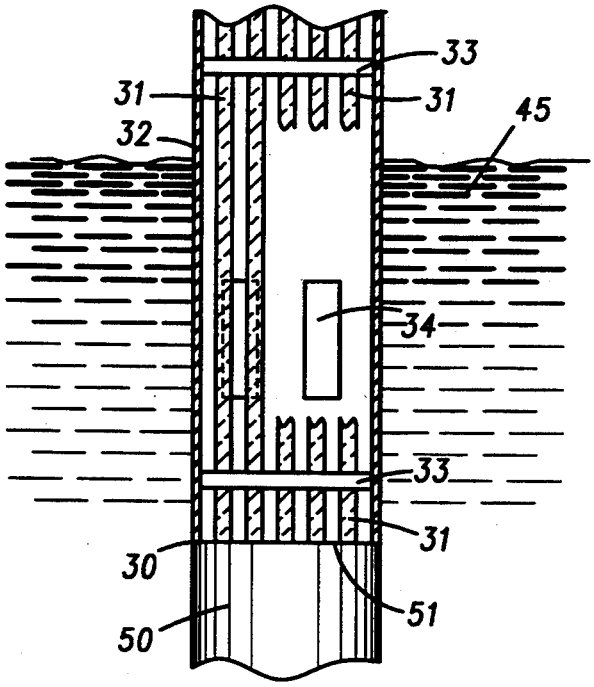
Fig. 8
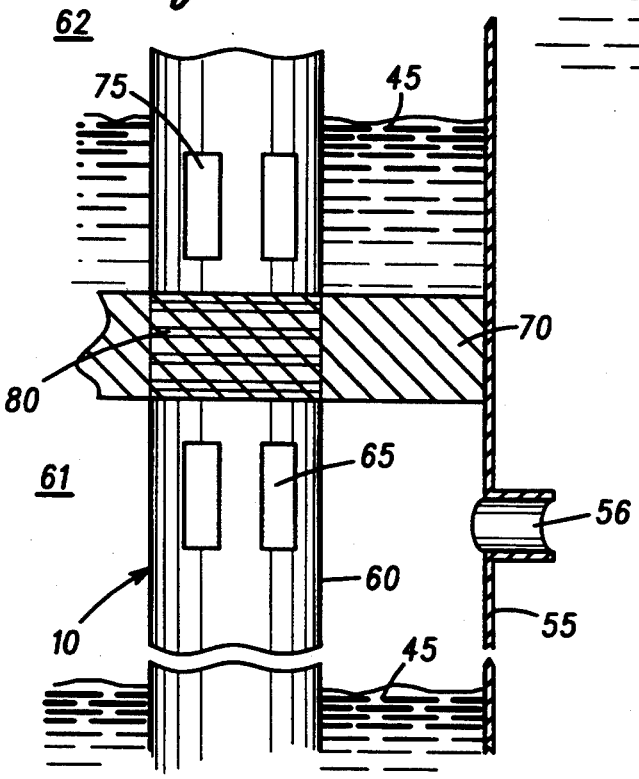

HIGH TEMPERATURE SUPERCONDUCTOR CURRENT LEADS

CONTRACTUAL ORIGIN OF THE INVENTION

The United States Government has rights in this invention pursuant to Contract No. W-31-109-ENG 38 between the U.S. Department of Energy and The University of Chicago representing Argonne National Laboratory.

BACKGROUND OF THE INVENTION

This invention relates to current leads for attachment to a cryogenic apparatus such as a superconducting magnet or instrument positioned in a cryostat. The cryogenic materials used to cool the superconducting magnet or instrument may be liquid helium, liquid hydrogen, liquid neon, or other coolants, these materials being well known in the cryogenic art. A cryogenic apparatus, such as a superconducting magnet or low temperature sensor, typically requires several current-carrying leads to supply power to the circuit or to read information into or out of the circuit. These leads introduce heat into the cryostat by thermal conduction and, if the leads are not superconducting, by Joule heating.

It is desirable to minimize the heat input into the cryostat in order to reduce the amount of cryogenic fluid boiled off in an open system or to reduce the power consumption in a cryostat cooled by a closed-cycle refrigerator.

Future space missions will include sensors and instruments operating at cryogenic temperatures, that is temperatures less than 77° K. In addition, long-term inorbit storage of liquid oxygen and liquid hydrogen will be required for propulsion by missions to the moon or to Mars or by orbit transit vehicles in Earth orbit. The heat leak into the stored cryogens, along with the heat leak due to or carried by current leads to the cold sensors and instruments can greatly increase the weight and power overhead associated with these cryogenic systems or reduce their lifetimes. Because both weight and power requirements are cost drivers for these missions, and because long lifetimes are required, cryogenic current leads with low heat input are an important means by which both weight and power requirements can be reduced and hence, by which the lifetime of the mission can be increased.

Many terrestrial superconducting devices will profit from a reduction of the heat loss associated with current leads. For example, it has been estimated that, for a five thousand MWh superconducting magnet energy storage system, the use of high temperature superconducting material for the leads has the potential to reduce the parasitic refrigeration losses of the system by more than half. Even for small laboratory superconducting magnets, the loss of helium in a normal operation of the magnets is often a concern. Frequently, it is not cost effective to recover all the helium that evaporates in the system so that a reduction in the amount of the helium evaporated due to introduction of heat into the cryostat is valuable.

OBJECTS OF THE INVENTION

Accordingly, an object of the invention is to provide an electrical current lead between a power source and an application where the application is at a low temperature and in particular where the application is at cryostatic temperatures wherein the electrical current lead reduces the amount of heat introduced into the cryostat.

Another object of the invention is to provide a current lead to an apparatus bathed in a cryogenic fluid and to minimize the loss of cryogenic fluid from the apparatus.

Another object of the invention is to use a high temperature superconductor current lead of high mechanical strength which is either conduction cooled or vapor cooled.

Yet another object of the invention is to provide an electrical lead having one end for connection to an apparatus positioned in a cryogenic environment and the other end for connection to an apparatus outside the cryogenic environment, the electrical lead comprising a high temperature superconductor wire and an electrically conductive material distributed therein, the electrically conductive material being present at the one end of the lead at a concentration ill the range of from 0 to about 3% by volume, the electrically conductive material being present at the other end of the lead at a concentration of less than about 20% by volume.

Another object of the invention is to provide an electrical lead having one end for connection to an apparatus positioned in a cryogenic environment and having the other end for connection to an apparatus outside the cryogenic environment, the electrical lead comprising a high temperature superconductor wire and an electrically conductive material distributed therein, the electrically conductive material being present at the one end in a concentration of less than about 3% by volume, the electrically conductive material being present at the one end in a concentration of less than about 20% by volume, wherein the area of the lead transverse to the longitudinal axis is greater at the other end of the lead than at the one end.

A final object of the invention is to provide an electrical lead having one end for connection to an apparatus in a cryogenic environment and the other end for connection to an apparatus outside the cryogenic environment, the electrical lead comprising a plurality of elongated high temperature superconducting wires at least some of said high temperature superconducting wires including an electrically conductive material distributed therein present at the one ends of the high temperature superconducting wires at a concentration in the range off from 0 to about 3% by volume and at the other end of the high temperature superconducting wires at a concentration of less than about 20% by volume, a sheath enclosing the elongated high temperature superconducting wires extending from the one ends of the high temperature superconducting wires to the other ends of the high temperature superconducting wires, the sheath at the one ends being a good thermal insulator, and means establishing a path for a cryogenic material to pass in heat exchange relationship from near the one ends of the high temperature superconducting wires toward the other ends thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 6 is a schematic illustration of a lead incorporating the invention in a cryogenic environment;

FIG. 7 is a schematic view showing a series of high temperature superconducting wires within a sheath with passages cut in the sheath to permit the introduction of cryogenic material for cooling purposes; and FIG. 8 is a view of another embodiment of the invention wherein the lead passes through different cryogenic materials such as liquid helium and liquid nitrogen.

DETAILED DESCRIPTION OF THE EMBODIMENT

Figure 2A:
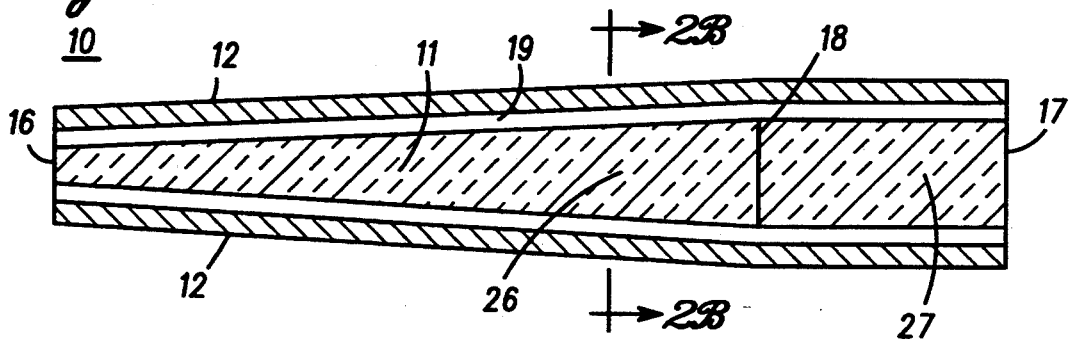
FIG. 2A is a cross sectional view of another embodiment of the inventive electrical lead.
Figure 2B:
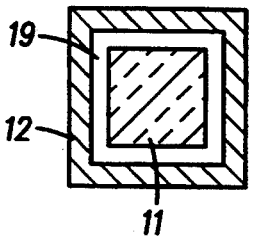
FIG. 2B is a view in section of the embodiment illustrated in FIG. 1A as seen along line 2B—2B thereof.
Figure 3:
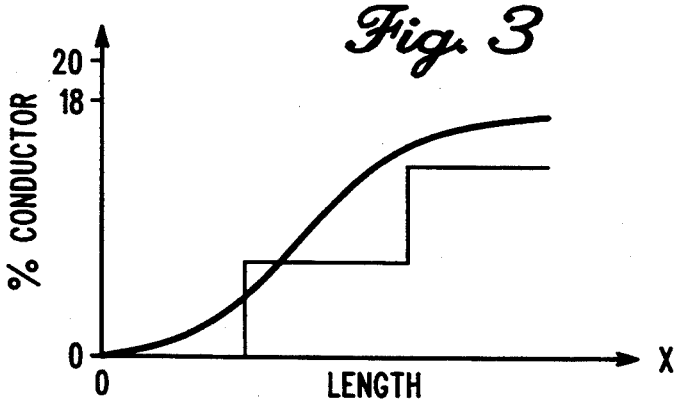
FIG. 3 is a graph showing the percent of electrically conductive material in relation to the length of the lead.

Referring now to the drawings and particularly to FIGS. 2 and 3 thereof, there is illustrated an electrical lead 10 incorporating the invention. High temperature ceramic superconductors of the perovskite materials are relatively poor heat conductors, and if appropriately modified, these conductors make superior leads in a cryogenic system. High temperature perovskite superconductors presently available have critical temperatures ranging from about 85° K. to about 125° K. The high temperature superconducting ceramic perovskite materials useful for this invention presently are the $Y—Ba_2—Cu_3—O_x$, the $Bi_2—Sr_2—Ca_2—Cu_3O_x$ and the $Tl_2—Ba_2—Ca_2—Cu_3—O_x$ and other related ceramic high-temperature superconductors. While at the present only the above-identified perovskite ceramics are available, the invention is broader in scope than those specific ceramic superconductors because the invention relies on the ceramic materials somewhat for their superconducting properties but principally also for their thermal insulating properties. Other ceramic superconductors in the future may have higher critical temperature, but that is not as important to the invention as the fact that ceramics are poor heat conductors. Although the bulk high temperature superconductors presently available have yet to exhibit high current densities in strong magnetic fields, they can be used as current leads in low magnetic fields where low current densities can be tolerated because the leads are relatively thick and relatively short. Typically, the leads of the invention may be up to 10 cm or longer in length, and for each amp of current carried, about 1 $mm^2$ in cross-sectional area. Current densities now achievable in the perovskite ceramics can be improved in the inventive leads by the addition of a variety of materials which improve the overall mechanical and electrical performance of the leads. The general class of materials useful herein are those which are good electrical conductors, those which impart desired mechanical characteristics such as ductility, and those which do not chemically react with the high temperature superconducting ceramic. The materials which are available and which are preferred are silver, gold, platinum, various mixtures of those compounds and alloys of the metals. Since the metals themselves are good heat conductors, they cannot be present in any significant degree at the cold end of the current lead. By the cold end of the current lead, it is meant that end of the lead which is attached to the superconducting magnet or other apparatus in a cryogenic material such as liquid helium. The hot or warm end of the lead 10 can therefore contain a much higher concentration of the electrical conductor.

Accordingly, the invention is best achieved by incorporating the good electrical conductor in varying amounts along the length of the lead 10 where the concentration of the electrical conductor is low or nonexistent at the cold end of the lead and is higher at the other or hot end of the lead.

Returning to the figures, the lead 10 includes the perovskite ceramic 11 which may be surrounded by a sheath 12, the sheath 12 being made up of two general portions 13 of a non thermal conducting material and a portion 14 which may be a good thermal conductor. The ceramic portion 11 has distributed therethrough particulates 15 of an electrically conducting material which provides the mechanical and electrical characteristics described above such as ductility, malleability, or improved fracture toughness, which may be desired for the lead. As can be seen from FIG. 1, the concentration of the particulates 15 is less at the cold end 16 of the lead and increases toward the hot or warm end of the lead 17, which could be at room temperature or some intermediate temperature, such as 77° K.

Figure 1:
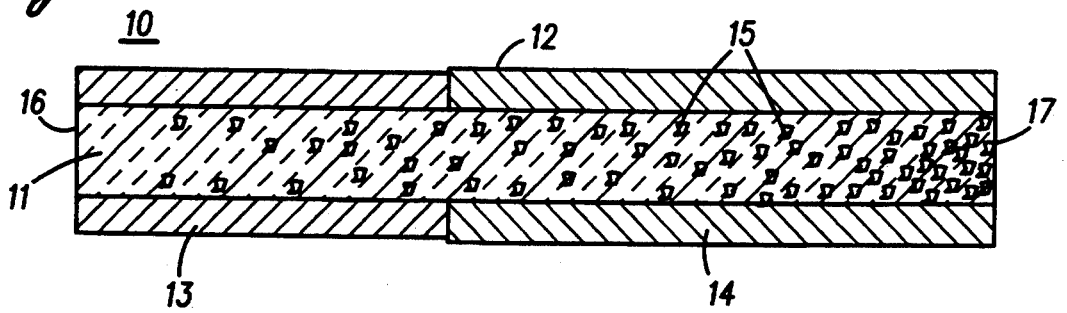
FIG. 1 is a schematic sectional view of an electrical lead illustrating the invention.

More specifically, the electrical material 15, which for sake of brevity will be referred to as silver, may range at the cold end from a concentration of zero up to about 3% by volume. At the hot or warm end 17, the concentration of the silver particles 15 may be near to but less than 20 volume percent with 15 volume percent being preferred at the hot end 17, although as much as 18 volume percent may be used. The concentration increase and the rate of increase of the concentration does not form a portion of this invention, although reference to FIG. 3 shows that the increase in concentration of silver particles 15 from the one cold end 16 to the other hot end 17 may be smooth or incremental. Because the sheath 12 has an end 16 which may be in contact with or in proximity to the apparatus in the cryostat material, if the sheath 12 were a good thermal conductor, it could introduce unwanted heat thereinto. Accordingly, as illustrated in FIG. 1, the sheath 12 is in two sections with the section 13 which is located in the cryostat being made of a non-thermal conducting material such as fiberglass reinforced epoxy resin. The other portion 14 of the sheath 12 may be of any material which provides good ductility such as silver. The exact location between the end 16 and end 17 of the thermal insulating portion 13 and the thermal conducting portion 14 of the sheath 12 is within the design skill of the art and is determined ultimately by the particular use of the lead 10.

In FIG. 2A is shown an embodiment of the invention in which the lead 10, is shown divided into superconducting portion 26 and non-superconducting portion 27, the two portions 26 and 27 meeting at a transition portion 18. The sheath 12 surrounds the lead leaving an annular gap 19 through which the cryogenic gas may flow and cool the lead 10. The sheath may be mechanically connected to the lead at end 16 or end 17.

The superconducting portion 26 and the non-superconducting portion 27 may be made from the same high-temperature superconductor ceramic 11, or combination of ceramic 11 and electrically conducting particles 15, as described for FIG. 1. Alternatively, the non-superconducting portion 27 may be made of copper, or any other metallic conductor and joined to the superconducting portion 26 at transition portion 18 by solder or other joining technique.

As is well known for superconducting materials, for a constant magnetic field, the critical current density increases as temperature decreases, and since the temperature along the lead 10 is colder near the cold end 16 and increases to the transition portion 18, the critical current density is larger as one proceeds closer to the cold end 16. Thus, in FIG. 2A, from the transition portion 18, the superconducting portion 26 of the lead 10 shows a continuously decreasing cross-sectional area approaching cold end 16. The smaller cross-sectional area at 16 results in less heat transfer into the liquid cryogen. The cross-sectional area of cold end 16 relative to the cross-sectional area of the transition portion 18 arid the taper from the portion 18 to cold end 16 is such that the superconducting portion 26 always remains in the superconducting state. The degree of taper along the length of lead 10 and particularly superconducting portion 26 thereof will depend on the actual critical current density as a function of temperature for the expected operating magnetic field. This can be measured on a short sample of lead material before the lead 10 is fabricated to determine the exact dimensions of the taper along the length.

The nature of the taper can be a continuous decrease of diameter for circular leads 10. Alternatively, the leads 10 can be rectangular in cross-section. In this case, the taper can occur in one direction, with the other dimension constant along the length, or the taper can be in both cross-sectional dimensions, resulting in a truncated pyramid for superconductor portion 26.

Figure 4:
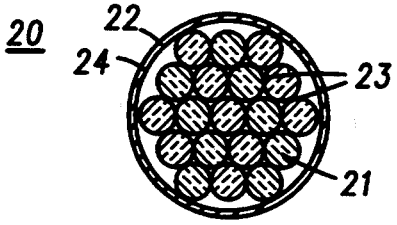
FIG. 4 is a cross sectional view of a vapor cooled electrical lead showing a plurality of high temperature superconducting wires surrounded by a sheath.

Referring now to FIG. 4, there is shown an embodiment of the invention or lead 20 in which a plurality of high temperature superconducting wires 21 circular in transverse cross section are nested in a sheath 22. The sheath 22 may be as previously described with respect to the sheath 12 but larger to accommodate the plurality of superconductor wires 21. Each of the superconductor wires 21 is similar to the superconductor wire previously described, that is it has a ceramic portion 11 having distributed therethrough a plurality of particulate electrically conducting particles 15 with the concentration thereof being varied from the cold end 16 to the hot end 17, all as previously described. The superconductor wires 21 which are circular in cross section are close packed in the conductor 20 thereby providing internal spaces 23 between the wires 21 and spaces 24 between the outermost wires 21 and the inside surface of the sheath 22. These spaces 23 and 24 extending the longitudinal extent of the lead 20 provide passages for the cryostatic material to pass through the lead 20 in order to cool the wires 21.

Figure 5:
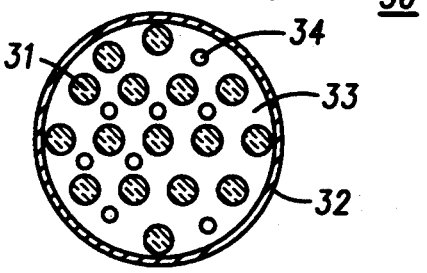
FIG. 5 is a view like FIG. 4 illustrating another vapor cooled embodiment: of the electrical lead incorporating the invention.

Referring to FIG. 5, there is another embodiment of the invention in which a lead 30 includes a plurality of superconducting wires 31 each of which is as previously described, that is a ceramic high temperature superconducting portion 11 with interspersed electrically conducting particles 15 wherein the concentration of the electrically conducting particles 15 varies from the cold end 16 of the lead to the hot end 17 of the lead 30. In the embodiment 30, the superconducting wires 31 are spaced one from another and maintained in the configuration by means of the sheath 32 and a spacer disc 33. The spacer disc 33 may be any suitable ceramic material, plastic, or metal. There may be a plurality of longitudinally spaced apart discs 33 to maintain the wires 31 in place along the length of the lead 30. For ease of construction, the ceramic disc 33 may be made from the same material as the ceramic portion 11 in each of the wires 31. Spaced among the wires 31 are apertures 34 in each disc 33 through which pass the cryostatic material or vapors of the cryostatic material in order to cool the superconducting wires 31 from the cold end 16 of the lead to the hot end 17 of the lead 30.

Referring now to FIG. 6, there is shown an electrical lead of the type hereinbefore discussed, having a sheath 12, 22 or 32 held in position by a lug 35 and a lug 36, as is well known in the art. The lug 35 is connected to a low temperature apparatus (not shown) such as a superconducting magnet or low temperature sensor while the lug 36 is connected to a high temperature power supply (not shown) or other device or apparatus operating at a significantly higher temperature than the low temperature apparatus. The sheath 22 has an open end 37 through which can flow a cryogen 45 such as liquid helium, the level of the cryogen being indicated in the drawing.

Finally, the upper end of the sheath 22 is connected to a gas collection cap 38 having a conduit 39 to an exhaust apparatus or refrigeration system (not shown) for condensing the evaporated cryogen material and returning it as a liquid to the cryogen 45.

Referring to FIG. 7, there is shown a lead 30 positioned within a cryogen 45 connected to a low temperature superconductor or cryostat device 50 wherein each of the leads 31 is connected by a butt weld 51 to the low temperature apparatus 50. As shown in FIG. 7, the sheath 32 is provided with two elongated apertures 34 through which the cryogen 45 can flow and be transmitted upwardly to cool the individual superconducting wires 31. It should be remembered that each of the wires 31 is provided with electrically conductive particulate 15 distributed therethrough such that the particulates are present at a concentration of from zero to less than about 3% by volume at the cold end 16 of the lead 30 positioned in the cryogen 45 and present at a concentration of less than 20% by volume and preferably about 15–18% by volume at the warm or hot end 17 of the lead 30 positioned above the level of the cryogen 45. In addition, it should be remembered that the sheath 32 is shown as a unitary piece in FIG. 7, it is in fact preferably constructed of a thermal insulating material 13 below the cryogen level 45 toward the cold end 16 of the sheath or the low temperature apparatus 50 and of a thermally conducting material 14 such as silver or copper at the upper or the warm end 17 of the sheath 32. In the event that copper or other sheathing material would adversely react with the perovskite ceramics used for the ceramic portion 11 of the wires 31, then alternative materials are available from which to make the upper portion 14 of the sheath 32 as previously described.

Referring now to FIG. 8, there is shown as embodiment of the invention wherein a current lead 10 is positioned in two different cryostatic materials on either side of a thermal insulator 70 which divides the dewar 55 into separate compartments, lower compartment 61 and upper compartment 62. The sheath 60 and hence the lead 10, extends into a liquid helium cryostat 45, the sheath 60 being provided with exhaust port 65 at the upper end of the lower compartment through which the helium gas passes after cooling the wires in the sheath 60. A helium exhaust 56 in the wall of the dewar exhausts helium gas from the dewar to a collection or refrigeration system.

In the upper chamber 62, the upper portion of the sheath 60 is positioned in liquid nitrogen 46 and is provided with ports 75 through which the liquid nitrogen can enter and cool the leads (not shown) which are vertically above the thermal insulator 70. The thermal insulator 70 may be of any suitable dense ceramic material so as to thermally insulate the helium section from the liquid nitrogen section to prevent the liquid nitrogen from freezing and prevent heat transfer into the lower chamber 61. A portion 80 of the thermal insulator 70 is a good electrical conductor but remains a good thermal insulator to provide passage of the leads (not shown) upward from the lower cryostat. Since helium is liquid at about 4° K. and nitrogen is liquid at about 77° K., it can be seen that a good thermal insulator 70 is required. It is within the skill of the art to prepare substantially 100% dense ceramics which will function as a thermal insulator in this embodiment of the invention in which the inventive leads extend through two different cryostatic fluids having substantially different boiling points.

It should be understood that many ceramics are not 100% dense and when a perovskite ceramic is used for the superconducting leads which is not 100% dense but is rather 50–10 volume percent voids, that is between 90% dense and 50% dense, helium gas can flow through the lead and vapor cool the lead at a sufficient rate such that the constructions illustrated in FIGS. 4 and 5, each of which provide for intimate contact of the cryogenic liquid and vapor with the lead is unnecessary, or at best, the requirement is reduced. Accordingly, the invention includes the vapor cooling of the leads hereinbefore described where the ceramics are sufficiently porous to permit vapor transport through the ceramic. The insulator 70 may be similar to a normal dewar wall 55 that is, although not so illustrated, two opposed surfaces with a vacuum therebetween. However, that portion 80 of the dewar wall or insulator 70 through which the leads pass has to be modified to permit the leads to extend through the wall.

While there has been disclosed what is considered to be the preferred embodiment of the present invention, it is understood that various changes in the details may be made without departing from the spirit, or sacrificing any of the advantages of the present invention.

The embodiments of the invention in which an exclusive property or privilege is claimed are defined as follows:

1. An electrical lead having one end for connection to an apparatus in a first cryogenic environment and the other end for connection to an apparatus outside the first cryogenic environment, said electrical lead comprising a high temperature superconductor wire and a good electrically conductive material having a concentration gradient distributed therein, said good electrically conductive material being present at the one end of said lead at a concentration in the range of from 0 to about 3% by volume, said good electrically conductive material being present at the other end of said lead at a concentration of less than about 20% by volume, and greater than at the one end having 0 to about 3% by volume and said concentration gradient of the material being substantially uniform from the one end to the other end of said lead.

2. The electrical lead of claim 1, wherein the electrically conductive material is selected from the group consisting of Ag, Au, Pt or mixtures or alloys thereof.

3. The electrical lead of claim 1, wherein said good electrically conductive material is Ag and the concentration thereof varies from less than 3% by volume at one end of the lead to not greater than about 18% by volume at the other end of the lead.

4. The electrical lead of claim 3, wherein the Ag concentration is about 15% by volume at the other end of the lead.

5. The electrical lead of claim 4, wherein the Ag concentration is zero at the one end of the lead.

6. The electrical lead of claim 1, wherein the high temperature superconductor is a ceramic perovskite having a density in the range of from about 50% to about 90% by volume.

7. The electrical lead of claim 6, wherein the high temperature superconductor is selected from $Y—Ba_2—Cu_3—O_x$, $Bi_1—Sr_2—Ca_2—Cu_3—O_x$ and $Tl_2—Ba_2—Ca_2—Cu_2—O_x$.

8. The electrical lead of claim 1, wherein the high temperature superconductor has a critical temperature greater than 77 ° K.

9. The electrical lead of claim 1 and further comprising an outer sheath surrounding said high temperature superconductor wire from the one end to the other end.

10. The electrical lead of claim 9, wherein the sheath at the one end is non-metallic.

11. The electrical lead of claim 10, wherein the sheath at the one end is an epoxy resin.

12. The electrical lead of claim 9, wherein the sheath is non-metallic at the one end and metallic at the other end.

13. The electrical lead of claim 1, wherein the first cryogenic environment is at a temperature of about 4° K. and the other end is at a second cryogenic environment less than about 90° K.

14. An electrical lead having one end for connection to an apparatus in a first cryogenic environment and the other end for connection to an apparatus outside the first cryogenic environment, said electrical lead comprising a high temperature superconductor wire and a good electrically conductive material having a concentration gradient distributed therein, said good electrically conductive material being present at the one end of said lead at a concentration in the range of from 0 to about 3% by volume, said good electrically conductive material being present at the other end of said lead at a concentration of less than about 20% by volume and greater than at the one end having 0 to almost 3% by volume and said concentration gradient of the material incrementally increasing from the one end toward the other end of the lead.

15. An electrical lead having one end for connection to an apparatus in a cryogenic environment and having the other end for connection to an apparatus outside the cryogenic environment, said electrical lead comprising a high temperature superconductor wire and a good electrically conductive material having a concentration gradient distributed therein, said good electrically conductive material being present at the one end in a concentration of less than about 3% by volume, said good electrically conductive material being present at the other end in a concentration of less than about 20% by volume, and greater than at the one end having less than about 3% by volume wherein the area of the lead transverse to the longitudinal axis is greater at the other end of the lead than at the one end.

16. The electrical lead of claim 15, wherein the lead is generally circular in transverse cross section.

17. The electrical lead of claim 15, wherein the electrically conductive material is selected from the group consisting of Ag, Au, Pt or mixtures or alloys thereof and the concentration varies from less than 3 volume percent at the one end to not greater than about 18 volume percent at the other end.

18. The electrical lead of claim 15, wherein the high temperature superconductor has a critical temperature greater than 77° K.

* * * * *